US005197163A

United States Patent [19]

Jörg

[11] Patent Number: 5,197,163

[45] Date of Patent: Mar. 30, 1993

[54] NIPPER UNIT FOR A COMBING MACHINE

[75] Inventor: Andreas Jörg, Neftenbach, Switzerland

[73] Assignee: Rieter Machine Works, Ltd., Winterthur, Switzerland

[21] Appl. No.: 890,816

[22] Filed: Jun. 1, 1992

[51] Int. Cl.[5] ..... D01G 19/16

[52] U.S. Cl. ..... 19/225; 19/235

[58] Field of Search ..... 19/225, 226, 227, 228, 19/235

[56] References Cited

U.S. PATENT DOCUMENTS

| | | | |
|---|---|---|---|
| 1,605,135 | 11/1926 | Nasmith . | |
| 4,947,521 | 8/1990 | Joerg et al. | 19/225 X |
| 4,951,360 | 8/1990 | Kishi et al. | 19/225 |

FOREIGN PATENT DOCUMENTS

| | | | |
|---|---|---|---|
| 0433333 | 8/1926 | Fed. Rep. of Germany . | |
| 4005899 | 4/1991 | Fed. Rep. of Germany . | |
| 1028022 | 2/1986 | Japan | 19/235 |
| 0485873 | 2/1970 | Switzerland . | |

*Primary Examiner*—Clifford D. Crowder

*Assistant Examiner*—John J. Calvert

*Attorney, Agent, or Firm*—Francis C. Hand

[57] ABSTRACT

The nipper unit comprises a lower nipper as well as a an upper nipper and an auxiliary nipper, the latter two each being movable with respect to the lower nipper between a closed position and an open position. The auxiliary nipper is spring-loaded against its closed position. If the upper nipper is in its opened position, the auxiliary nipper is in its closed position and is used to tightly clamp a lap on a lower nipper plate while a previously combed fiber tuft is detached therefrom. When the upper nipper moves to its closed position, stop elements arranged on the upper nipper come into contact with stop surfaces arranged on the auxiliary nipper and open the auxiliary nipper so that the lap on the lower nipper plate can be advanced. The timing of the opening of the auxiliary nipper is determined by the position of the stop elements on the upper nipper. Before the opening, the clamping force exerted by the auxiliary nipper is constant and does not depend on the time of the opening of the auxiliary nipper and on the opening width of the upper nipper.

15 Claims, 2 Drawing Sheets

NIPPER UNIT FOR A COMBING MACHINE

This invention relates to a nipper unit for a combing machine.

Heretofore, various types of nipper units have been known for combing machines. Generally, the nipper units have been constructed with a lower nipper and an upper nipper which are moved relative to each other between a closed position in which a tuft extending from a delivered lap is firmly held for combing purposes and an open position which permits removal of the combed tuft.

It has also been known from European Patent Application 0 364 779 to provide such nipper units with an auxiliary nipper which can also be moved between a closed position and an open position relative to the lower nipper so as to hold the lap against the lower nipper when the upper nipper has moved away from the lower nipper. In such cases, the lower nipper is moved between a retracted position and an advanced position relative to a combing roller. When the lower nipper is in the retracted position, the upper nipper is in the closed position with respect to the lower nipper so as to clamp a fiber tuft for combing out by a rotating comb cylinder of the combing machine. Thereafter, when the lower nipper is moved to the advanced position, the upper nipper takes up the open position permitting the combed fiber tuft to be detached from the lap by a detaching roller while the lap remains resting in the lower nipper. During the detachment of the combed fiber tuft, the auxiliary nipper is in a closed position to clamp the lap onto the lower nipper so as to prevent, as best as possible, detachment of the tufts that have not yet been combed by the rotating comb cylinder.

In the described structure, the movements of the auxiliary nipper are derived from the movements of the upper nipper through various coupling elements so that separate driving units are not required for the auxiliary nipper. For example, European Patent Application 0 364 779 provides various rigid links or resilient links for coupling the upper nipper with the auxiliary nipper. The coupling is such that when the upper nipper is moved from the closed position to the open position thereof, the coupling elements swivel the auxiliary nipper is an opposite direction until the auxiliary nipper reaches the closed position thereof. The coupling elements thus gradually produce a clamping force on the auxiliary nipper. As soon as the detachment of the fiber tuft begins (which is the case before the nipper unit has fully reached its advanced position and the upper nipper its open position), the clamping force of the auxiliary nipper should have reached a sufficient value. As the clamping force continues to rise thereafter, this can lead to a situation in which the clamping force becomes too high when the upper nipper reaches its open position. Furthermore, the auxiliary nipper must not be in its closed position whenever laps are advanced in the nipper unit before or after the detachment (so-called feeding). This means that during the opening of the upper nipper, the auxiliary nipper must reach its closed position relatively late. This makes the build-up of a sufficient clamping force until the beginning of the detachment rather difficult while it is possible to alter the clamping force by displacing the coupling positions of the coupling elements in the upper nipper and/or in the auxiliary nipper, this would also lead to a displacement of the time at which the auxiliary nipper reaches its closed position. Consequently, this presents a dilemma.

Accordingly, it is an object of the invention to be able to vary the clamping force of an auxiliary nipper in the nipper unit for a combing machine without changing the time at which the auxiliary nipper would reach a closed position relative to a lower nipper.

It is another object of the invention to make the magnitude of the clamping force of an auxiliary nipper on a lower nipper of a nipper unit for a combing machine independent of the setting of the time at which the auxiliary nipper reaches a closed position.

Briefly, the invention provides a nipper unit for a combing machine which includes a lower nipper, an upper nipper, means for moving the upper nipper relative to the lower nipper between a closed position for engaging a tuft therebetween and an open position for removal of a combed tuft from between the nippers and an auxiliary nipper disposed for movement relative to the lower nipper between a closed position for engaging a lap therebetween and an open position for movement of the lap therebetween.

In accordance with the invention, a spring is provided for biasing the auxiliary nipper into the closed position thereof along with coupling means for selectively coupling the upper nipper to the auxiliary nipper during the movement of the upper nipper in a path from the open position thereof to the closed position thereof in order to cause the auxiliary nipper to move against the spring from the closed position thereof to the open position thereof. The coupling means also serve to uncouple the upper nipper from the auxiliary nipper during movement of the upper nipper to the open position from the closed position thereof. Thus, the coupling means are arranged in such a way as to couple the upper nipper with the auxiliary nipper only during a part of the path of movement of the upper nipper.

Whenever the upper nipper is situated in the area of its closed position, the coupling means will hold the auxiliary nipper in its open position. As soon as the auxiliary nipper reaches this position, the auxiliary nipper is released by the coupling means and the magnitude of the clamping force is solely defined by the spring loading of the auxiliary nipper. During the further opening of the upper nipper, the clamping force remains constant at a given and, if desired, adjustable magnitude which is independent of the time at which the auxiliary nipper reaches its closed position.

These and other objects and advantages of the invention will become more apparent from the following detailed description taken in conjunction with the accompanying drawings wherein.

Figure 1:
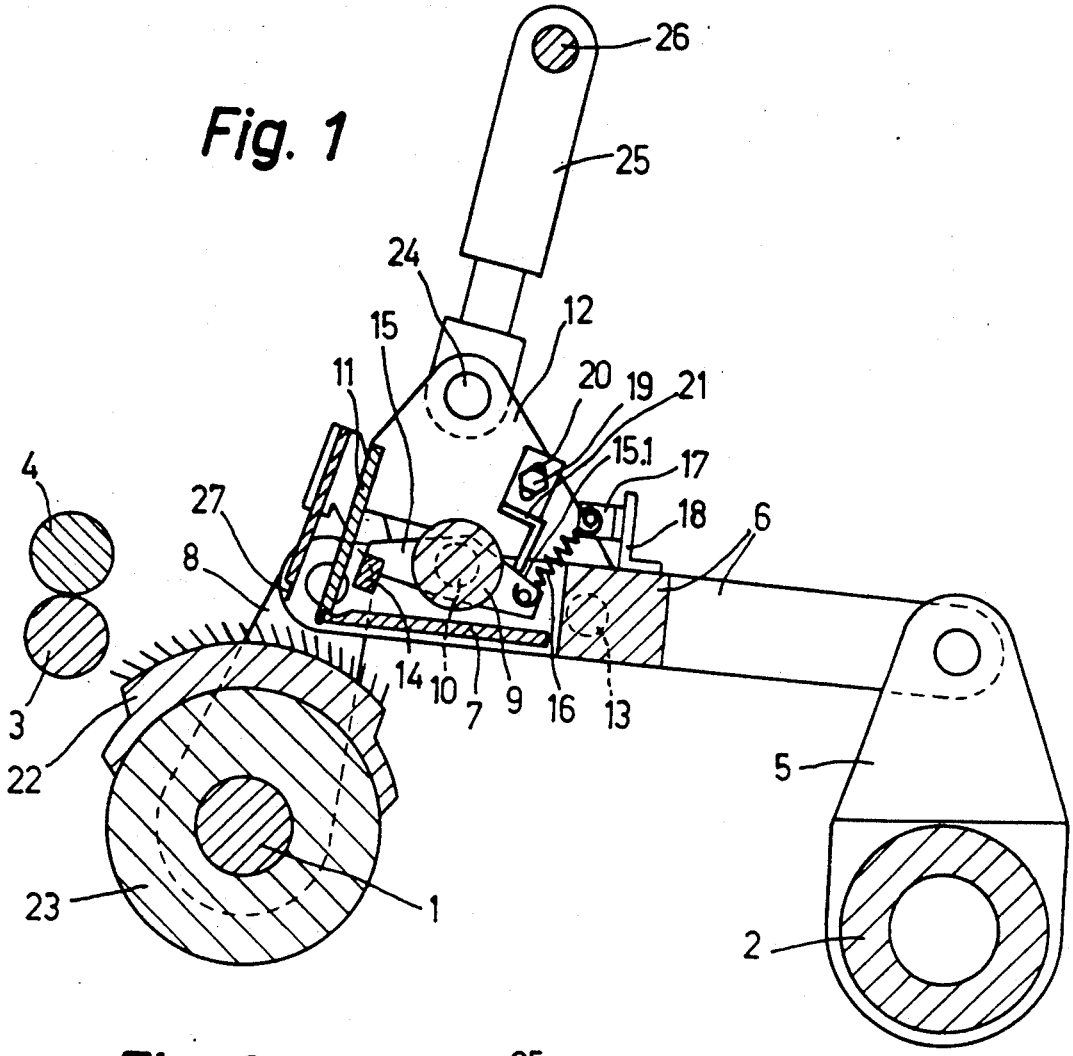
FIG. 1 illustrates a part cross-section schematic view of a nipper unit constructed in accordance with the invention for use in a combing machine.

Referring to FIG. 1, a combing machine includes a continuously rotating comb shaft 1, a reciprocating nipper shaft 2 parallel to the rotating comb shaft 1, a detaching roller 3 and a detaching printing roller 4, with all components being held in a machine frame (not shown). The nipper shaft 2 carries crank arms 5 which are connected to a rear end of a lower nipper 6 which carries a lower nipper plate 7. The front end of the lower nipper 6 is coupled to a front support 8 which is swivellably held about an axle of the rotating comb shaft 1. A feed cylinder 9 with a shaft 10 is rotatably mounted on the lower nipper unit 6 above the lower nipper plate 7 and is disposed for feeding a lap (not shown) between the cylinder 9 and the lower nipper plate 7.

The nipper unit for the combing machine also includes an upper nipper having an upper plate 11 and a pair of arms 12 to which the upper nipper plate 11 is secured at each end. As indicated, the upper nipper arms 12 are pivotally mounted on a journal pin 13 on the lower nipper 6.

Figure 2:
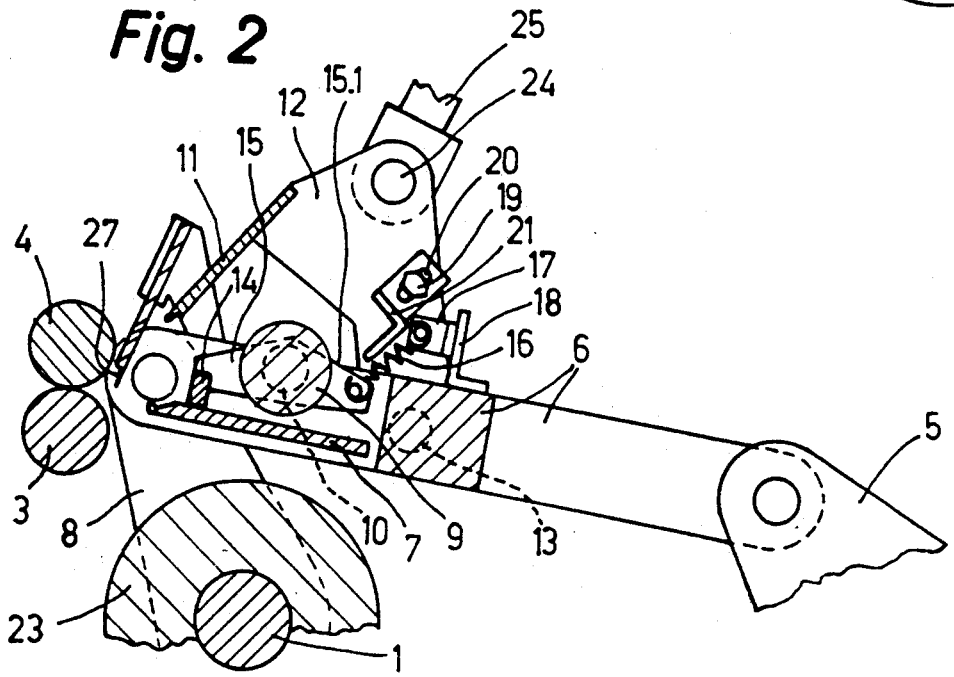
FIG. 2 illustrates a view similar to FIG. 1 with an upper nipper in an open position in accordance with the invention.

The nipper unit also includes an auxiliary nipper in the form of a holddown selvedge 14 (e.g. a bar) which is attached at each end to a forward arm of a two-armed lever 15. The auxiliary nipper 14 is disposed for movement relative to the lower nipper plate 7 between a closed position (as shown in FIG. 2) for engaging a lap therebetween and an open position (as shown in FIG. 1) for movement of the lap therebetween. As indicated, each two armed lever 15 is pivotally mounted on the axis of rotation of the feed cylinder 9, which axis is parallel to the axis of the journal 13 on which the arms 12 of the upper nipper are mounted. As is also indicated in FIG. 1, the axis of rotation of each lever 15 is disposed in front of the axis of the journal pin 13 relative to the jaw end of the lower nipper plate 7.

The nipper unit also includes at least one spring 16 for biasing the auxiliary nipper 14 into the closed position thereof. As illustrated, the spring 16 is connected at one end to a bracket 17 which is secured to an angle 18 fixed to the lower nipper 6 while the opposite end of the spring 16 is connected to a pin or the like on one arm of the lever 15. The bracket 17 may also be adjustably mounted on the angle as to height, for example, by means of a screw (not shown) which extends through an elongated opening in the bracket 17. In this way, the spring force of the spring 16 on the lever 15 can be adjusted.

The nipper unit is also provided with coupling means for selectively coupling the upper nipper 11, 12 to the auxiliary nipper 14 during movement of the upper nipper 11, 12 in a path from an open position (FIG. 2) to a closed position (FIG. 1) in order to cause the auxiliary nipper 14 to move against the spring 16 from a closed position thereof (FIG. 2) to an open position thereof (FIG. 1). The coupling means also serves to uncouple the upper nipper 11, 12 from the auxiliary nipper 14 during movement of the upper nipper to the open position thereof from the closed position thereof. To this end, the coupling means includes a pair of stop elements 21, only one which is shown. Each stop element 21 is in the shape of a tappet and is adjustably attached to a respective upper nipper arm 12 by means of a screw 19 which passes through an elongated opening 20 in the stop element 21. As indicated in FIG. 1, the lower end of each stop element 21 abuts an upper side 15.1 of the rear arm of a respective lever 15, which side 15.1 serves as a stop surface. Each stop element 21 serves to pivot the respective lever 15 against the force of the spring 16 in a clockwise direction as viewed.

As illustrated, the combing machine also includes a comb segment 22 which is mounted on a rotatable cylinder 23 about the comb shaft 1 for combing a tuft held between the lower plate 7 and upper plate 11 (FIG. 1).

In addition, a means is provided for moving the upper nipper 11, 12 relative to the bottom nipper 6 between the closed position of FIG. 1 for engaging the tuft therebetween and the open position of FIG. 2 for removal of a combed tuft. This means includes a guide means 25, such as a cylinder and piston device, which is pivotally connected at one end to the arms 12 of the upper nipper via a journal 24 and pivotally mounted at an opposite end on a shaft 26 that is rigidly attached to a frame (not shown) of the combing machine.

Still further, the nipper unit carries a top comb 27 as is known which is mounted via suitable brackets on the lower nipper 6.

When the nipper unit is in a retracted or rear end position as shown in FIG. 1, the upper nipper unit 11, 12 is disposed in its closed position. During normal operation, a fiber tuft (not shown) is ridigly clamped between the front edges of the lower nipper plate 7 and upper nipper plate 11. In this way, the front edges of the respective nipper plates 7, 11, form jaws. The tuft is then combed out by the rotating comb segment 22. At the same time, the stop elements 21 which have been lowered onto the upper sides 15.1 of the rear arms of the respective levers 15 hold the auxiliary nipper 14 in its open position where the lap hold-down selvedge 14 is situated at a distance from the lower nipper plate 7.

Thereafter, as shown in FIG. 2, the lower nipper 6 is moved to an advanced position with the opening of the nipper unit taking place. During the advance movement of the nipper unit, the guide means 25 pivots the upper nipper 11, 12 about the journal 13 in the upper direction, as viewed. The stop elements 21 also move upwardly in combination with the upper nipper arms 12 and the tension spring 16 pivots the auxiliary nipper unit 14, 15 in a counter-clockwise direction until the lap fold-down selvedge 14 rests on the lower nipper plate 7 or on the lap (not shown) that rests on the lower nipper plate 7. Thereafter, the stop elements 21 leave the upper sides 15.1 of the rear arms of the levers 15 and continued upward movement alone. That is, the stop elements 21 are uncoupled from the levers 15. The clamping force exerted by the auxiliary nipper 14 is thus determined by the tension spring 16 and remains constant for the further advance movement of the nipper unit and the opening movement of the upper nipper plate 11.

The magnitude of the clamping force of the auxiliary nipper 14 can be set to the desired value by adjusting the bracket 17 with respect to the angle 18.

By adjusting the stop elements 21 with respect to the upper nipper arms 12, it is possible to set the closing time of the auxiliary nipper 14, 15, i.e., the time at which the lap holding down slevedge 14 comes to rest on the lower nipper plate 7 or the lap.

While the nipper unit 6, 7, 11, 12 is situated in the zone of its front end position as shown in FIG. 2, the fiber tuft, which has been combed out by the rotating comb segment 22, is joined on the detaching roller 3 with the previously formed combed silver fleece and drawn off through the top comb 27 that rests on the lower nipper 6, whereby the tuft is detached from the lap to be combed which is still clamped under the selvedge 14. The slevedge 14 clamps the lap that comes from the feed cylinder 9 in front of the feed cylinder 9 and at a short distance behind the front edge of the lower nipper plate 7 onto the latter.

The nipper unit is then moved back to the rear end position in accordance with FIG. 1, whereby the upper nipper 11, 12 is lowered to its closed position and the stop elements 21 come into contact with the upper sides 15.1 of the rear arms of the levers 15 and thus pivot the auxiliary nipper 14, 15 to its opened position. During the forward or backward movement of the feed cylinder 9 or during the return movement of the nipper unit, the feed cylinder 9 can advance additional laps to be combed under the lap holding-down slevedge 14 that is lifted up by the lower nipper plate 7.

Usually, the front end position of the nipper unit in the combing machine (as shown in FIG. 2) and thus the setting distance (i.e. the distance between the detaching cylinder 3 and the front edge of the lower nipper plate 7 in its front end position) is adjustable. Because the upper nipper 11, 12 is moved by the guide means 25, a change in the front end position of the nipper unit leads to a change of the opening angle of the upper nipper 11, 12. This change has no influence in the nipper unit on the magnitude of the clamping force with which the auxiliary nipper 14, 15 presses the lap onto the lower nipper plate 7 in the area of the front end position of the nipper unit, because the magnitude of this clamping force is determined by the force of spring 16 (which, as was explained above, is adjustable). However, there is a change in the time at which the auxiliary nipper 14, 15 reaches its closed position during the forward movement of the nipper unit and at which the stop elements 21 lift off from the levers 15. The same applies when the stop elements 21 come into contact with the levers 15 during the return movement of the nipper unit and open the auxiliary nipper 14, 15. This change can be compensated for in a very simple manner by readjusting the coupling elements 21 with respect to the upper nipper arms 12.

The rear arms of the levers 15 serve as coupling elements in the auxiliary nipper 14, 15 in that the upper sides 15.1 of the rear arms cooperate with the stop elements 21 of the upper nipper arms 12. Naturally, it would also be possible to make the rear arms or their arms adjustable with respect to the front arms and the lap holding-down selvedge 14. For example, adjustable elements could be provided on the rear arms of the levers whose upper side would then cooperate with the stop elements 21.

Figure 3:
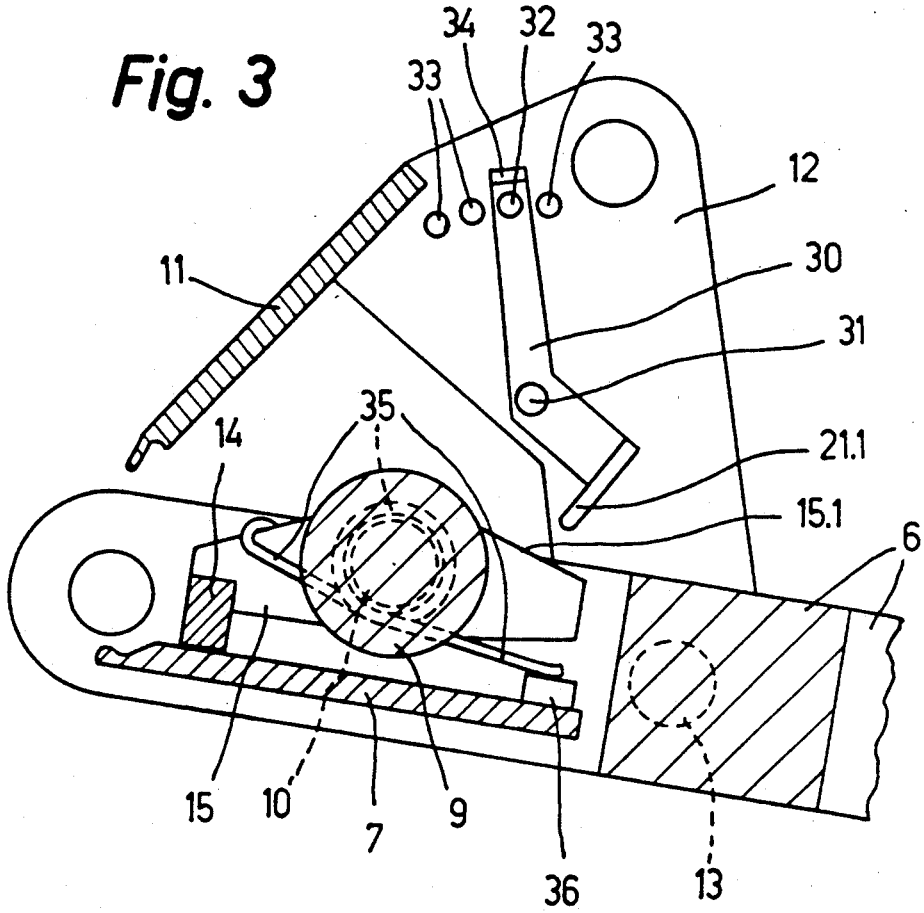
FIG. 3 illustrates a view similar to FIG. 2 of a modified nipper unit employing a coil spring.

Referring to FIG. 3, wherein like reference characters indicate like parts as above, the coupling means may be in the form of stop elements 21.1 on the upper nipper arms 12 which can be adjusted in a very simple manner. Each of the stop elements 21.1 is arranged as a tappet and is carried by a two-armed lever 30 which is swivellably connected about an axle 31 secured to the arms 12. The front arm of the lever 30 carries a notch projection 32 which cooperates with notch recesses 33 in the upper nipper arm 12. The lever 30 can easily be adjusted by means of an easily accessible handle element 34 at one end of the lever 30. Naturally, the lever 30 could be provided with a notch recess and could cooperate with notch projections on the upper nipper arm 12. Also, the lever 30 could carry an adjusting screw for threading into notch holes in the upper nipper arms 12.

FIGS. 1 and 2 show a tension spring 16 as an example for the spring loading of the auxiliary nipper 14, 15. However, any other type of spring may be used, for example a pressure spring may be used between the lower nipper plate 7 and the rear arms of the lever 15. A further option that allows a simpler arrangement of parts of the nipper unit is shown in FIG. 3. In this case, use is made of coil springs 35 which act as torsion springs which are wound around the shaft 10 of the feed cylinder 9 and which are hooked into the front arm of the respective lever 15 at one end and which are supported at the other end by an element 36 held in the lower nipper 6, 7. The element 36 can be adjustable in height with respect to the lower nipper 6, 7 in a manner that is not shown so as to adjust the tension force of the spring 35.

The invention thus provides a nipper unit in which the magnitude of the clamping force of an auxiliary nipper is independent of the time at which the auxiliary nipper comes into a closed position relative to a lower nipper.

What is claimed is:

1. A nipper unit for a combing machine comprising a lower nipper;

an upper nipper;

means for moving said upper nipper relative to said lower nipper between a closed position for engaging a tuft therebetween and an open position for removal of a combed tuft from between said nippers;

an auxiliary nipper disposed for movement relative to said lower nipper between a closed position for engaging a lap therebetween and an open position for movement of the lap therebetween;

a spring for biasing said auxiliary nipper into said closed position thereof; and coupling means for selectively coupling said upper nipper to said auxiliary nipper during movement of said upper nipper in a path from said open position thereof to said closed position thereof to cause said auxiliary nipper to move against said spring from said closed position thereof to said open position thereof, said coupling means uncoupling said upper nipper from said auxiliary nipper during movement of said upper nipper to said open position thereof from said closed position thereof.

2. A nipper unit as set forth in claim 1 wherein said coupling means is adjustable to vary a point of coupling of said upper nipper to said auxiliary nipper in said path of movement of said upper nipper.

3. A nipper unit as set forth in claim 1 wherein said spring is adjustable to vary a spring force imposed on said auxiliary nipper.

4. A nipper unit as set forth in claim 1 wherein said upper nipper is pivotally mounted on a first axis relative to said lower nipper and said auxiliary nipper is pivotally mounted on a second axis parallel to said first axis.

5. A nipper unit as set forth in claim 4 wherein said second axis is disposed in front of said first axis relative to a jaw end of said lower nipper.

6. A nipper unit as set forth in claim 5 which further comprises a feed cylinder rotatably mounted on said second axis for feeding a lap between said cylinder and said lower nipper.

7. A nipper unit as set forth in claim 1 wherein said auxiliary nipper is a pivotally mounted two-armed lever having a lap hold-down selvedge on one arm and said coupling means include a stop element connected to one of said upper nipper and a second arm of said lever for abutting the other of said second arm and said upper nipper.

8. A nipper unit as set forth in claim 7 wherein said stop element is adjustably mounted on said upper nipper.

9. A nipper unit as set forth in claim 1 wherein said spring is connected at one end to said lower nipper and at an opposite end to said auxiliary nipper.

10. A nipper unit as set forth in claim 9 wherein said auxiliary nipper is pivotally mounted on said lower nipper to pivot between said positions thereof.

11. A nipper unit as set forth in claim 10 which further comprise a lap feed cylinder rotatably mounted on a first axis on said lower nipper and wherein said spring is coil spring disposed about said first axis with one end engaging said lower nipper and a second end engaging auxiliary nipper.

12. A nipper unit for a combing machine comprising a lower nipper having a lower nipper plate mounted thereon;

an upper nipper having an upper nipper plate mounted thereon;

means for moving said upper nipper relative to said lower nipper between a closed position for engaging a tuft therebetween and an open position for removal of a combed tuft from between said nipper;

an auxiliary nipper disposed for movement relative to said lower nipper between a closed position for engaging a lap therebetween and an open position for movement of the lap therebetween;

a spring connected between said lower nipper and said auxiliary nipper for biasing said auxiliary nipper into said closed position thereof; and a stop element mounted on said upper nipper for abutting said auxiliary nipper during movement of said upper nipper from said auxiliary nipper during movement of said upper nipper towards said open position thereof.

13. A nipper unit as set forth in claim 12 wherein said auxiliary nipper is a pivotally mounted two-armed lever having a lap hold-down selvedge on one arm.

14. A nipper unit for a combing machine comprising a lower nipper having a lower nipper plate thereon;

an upper nipper having an upper nipper plate thereon;

means for moving said upper nipper relative to said lower nipper between a closed position for engaging a tuft therebetween and an open position for removal of a combed tuft from between said nipper;

an auxiliary nipper pivotally mounted on a first axis on said lower nipper for movement between a closed position for engaging a lap and an open position for movement of a lap thereby;

a coil spring disposed about said first axis with one end engaging said lower nipper and a second end engaging said auxiliary nipper for biasing said auxiliary nipper into said closed position thereof; and an auxiliary nipper disposed for movement relative to said lower nipper between a closed position for engaging a lap therebetween and an open position for movement of the lap therebetween.

15. A nipper unit as set forth in claim 14 wherein said auxiliary nipper is a pivotally mounted two-armed lever having a lap hold-down selvedge on one arm.

* * * * *